US006059388A

United States Patent [19]

Wheatley, Jr.

[11] Patent Number: 6,059,388

[45] Date of Patent: May 9, 2000

[54] CONSEALABLE JEWELRY BOX

[76] Inventor: William B. Wheatley, Jr., 804 Rams Rd., Shepardsville, Ky. 40165

[21] Appl. No.: 09/271,766

[22] Filed: Mar. 18, 1999

Related U.S. Application Data

[60] Provisional application No. 60/078,434, Mar. 18, 1998.

[51] Int. Cl.[7] ..... A47F 5/08

[52] U.S. Cl. ..... 312/246; 312/204; 312/319.1

[58] Field of Search ..... 109/47; 312/242, 312/245, 246, 293.2, 204, 319.1, 9.15, 9.16, 9.11, 9.47, 9.57; 206/6.1, 566

[56] References Cited

U.S. PATENT DOCUMENTS

| | | | |
|---|---|---|---|
| 1,895,061 | 1/1933 | Worssam | 312/319.1 X |
| 2,470,993 | 5/1949 | Kramer | 312/204 X |
| 3,899,982 | 8/1975 | Fetzek | 312/246 X |
| 4,155,608 | 5/1979 | Orlewicz | 312/242 X |
| 4,261,122 | 4/1981 | LeVine | 312/204 X |
| 4,324,446 | 4/1982 | Le Sage | 312/246 X |
| 4,653,818 | 3/1987 | DeBruyn | 312/246 |
| 4,687,103 | 8/1987 | Corbett | 206/566 |
| 4,800,822 | 1/1989 | Adkins | 312/319.1 X |
| 4,901,651 | 2/1990 | Herron | 312/204 X |
| 5,066,079 | 11/1991 | Lawrence | 312/204 |
| 5,141,300 | 8/1992 | Ciesla | 312/245 X |
| 5,511,873 | 4/1996 | Mech | 312/246 X |
| 5,570,938 | 11/1996 | Butler | 312/242 X |
| 5,706,943 | 1/1998 | Yu | 312/9.11 X |

*Primary Examiner*—Peter M. Cuomo
*Assistant Examiner*—James O. Hansen
*Attorney, Agent, or Firm*—Kenneth L Tolar

[57] ABSTRACT

A concealable jewelry box for attaching to the back surface of furniture such as drawers, a mirror or a similar item. The device includes a substantially rectangular housing having a planar front surface, a planar back surface, a top panel, a lower panel, a side panel and an opening opposite the side panel. A drawer component for holding jewelry items is slidably received within the housing interior and is locked therein with a spring biased catch member. The housing side panel is pivotable and has a spring thereon that releases the catch member and ejects the drawer through the housing opening.

4 Claims, 1 Drawing Sheet

CONSEALABLE JEWELRY BOX

This application is entitled to the benefit of the filing date of provisional application Ser. No. 60/078,434 filed on Mar. 18, 1998.

BACKGROUND OF THE INVENTION

The present invention relates to a jewelry box, and more specifically, a jewelry box that may be removably attached to the back surface of furniture allowing the box to be stored in an inconspicuous location.

DESCRIPTION OF THE PRIOR ART

Jewels are often stored in jewelry boxes and other similar lockable devices to prevent theft thereof. The boxes are sometimes hidden in a drawer, beneath a bed or in a similar location so that a potential thief will be unable to locate the box. However, burglars often ransack a house until the jewel box is found. Once located, the box may be easily pried open or the burglar may simply take the box. Accordingly, there is currently a need for a jewelry box that allows jewelry to be conveniently stored in an inconspicuous location that is nearly impossible for a burglar to locate. Although lockable devices for storing valuables exist in the prior art, none have the unique features and advantages of the present invention. For example, U.S. Pat. No. 3,899,982 issued to Fetsek relates to a retractable drawer arrangement for a dash board.

U.S. Pat. No. 4,324,446 issued to LeSage discloses a jewelry storage case including a front portion and a back portion defining at least one compartment therebetween. The front portion comprises a pair of closure members hingedly mounted to the back portion to provide easy access to the compartments. The device is configured to retain jewelry in a spaced orderly fashion.

U.S. Pat. No. 4,653,818 issued to DeBruyn discloses an under shelf storage arrangement.

U.S. Pat. No. 5,511,873 issued to Mech discloses a jewelry cabinet.

U.S. Pat. No. 5,570,938 issued to Butler discloses a wall mounted storage enclosure.

U.S. Pat. No. 4,155,608 issued to Orlewicz discloses a lockable gun cabinet. The present invention satisfies the above described need by providing a jewelry box that is attachable to the back surface of a piece of furniture such as a drawer or mirror thereby concealing the box from a thief or burglar. Furthermore, the device has a spring loaded retractable drawer allowing a user to quickly eject the drawer to remove or add jewels.

SUMMARY OF THE INVENTION

The present invention relates to a concealable jewelry box comprising a substantially rectangular hollow housing having planar front and back surfaces, a top panel, a lower panel, a side panel and an opening opposite the side panel. The side panel includes an upper end hingedly engaging the top panel and has a plate at a lower end thereof. Medially disposed on the inner surface of the hinged panel is an elongated horizontal tension spring. On an end of the lower panel proximal the plate is a wedged shaped groove. Slidably received within the open edge of the housing is a jewelry drawer which is substantially rectangular having an open side for accessing the drawer interior. Received within the drawer is a velvet covered panel having a plurality of hooks protruding therefrom for supporting various jewelry items. Vertically disposed along a side edge of the drawer component is an elongated, rigid spring having two ends with a first end affixed to an intermediate portion of the drawer side edge. An opposing end of the spring has a wedge shaped catch member attached thereto that seats within the wedge shaped groove on the housing lower panel to lock the drawer therein. The drawer may be quickly ejected by pivoting the hinged panel inwardly to dislodge the catch member from the groove allowing the horizontal tension spring to force the drawer through the housing open edge. It is therefore an object of the present invention to provide a jewelry box which may be quickly and conveniently attached to the back surface of a mirror, a chest of drawers or similar furniture items.

It is yet another object of the present invention to provide a jewelry box having a spring loaded retractable drawer. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
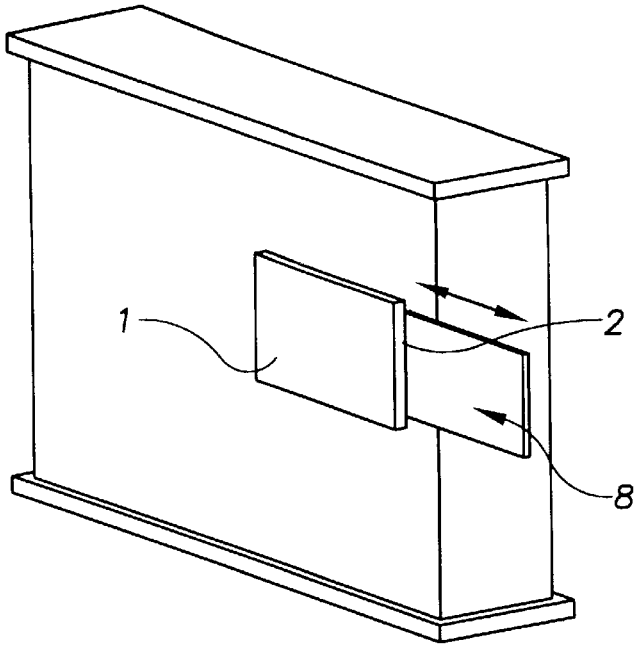
FIG. 1 depicts the inventive device on the back surface of a chest of drawers.
Figure 2:
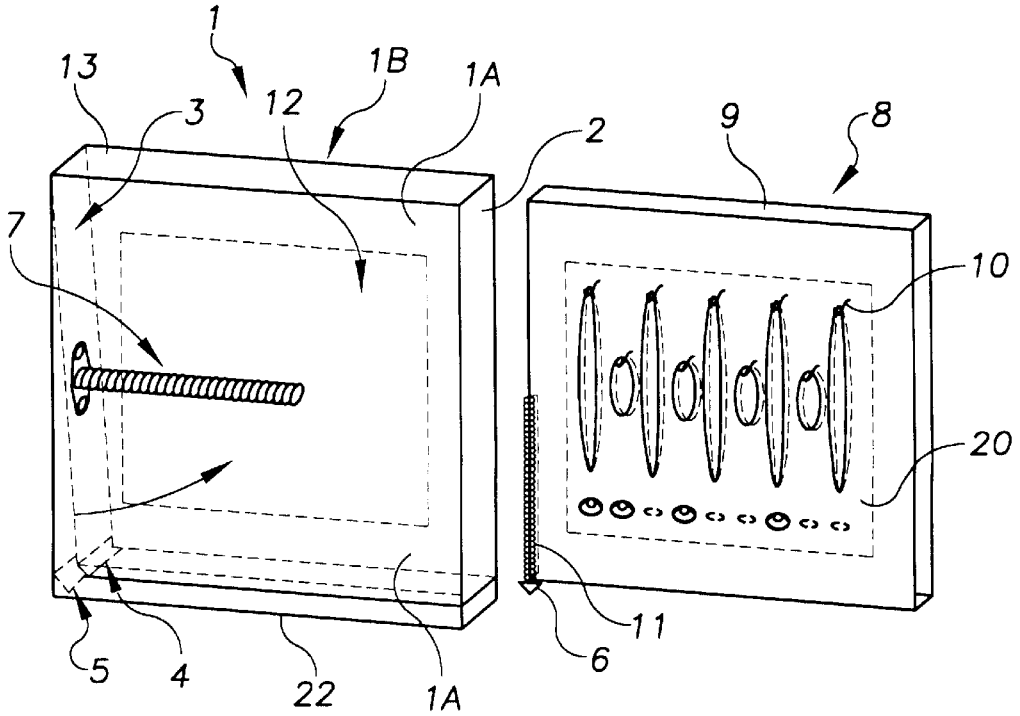
FIG. 2 depicts the housing according to the present invention with the retractable drawer removed therefrom and the internal components depicted in phantom.

Referring now to FIGS. 1 and 2, the present invention relates to a concealable jewelry box comprising a substantially rectangular, hollow housing 1 having planar front 1A and back 1B surfaces, a top panel 13, a lower panel 22, a side panel 3 and an opening 2 opposite the side panel that provides access to the housing interior. On the back surface of the housing is an adhesive substance 12 of the type generally known in the prior art allowing the housing to be quickly and easily attached to the back surface of a piece of furniture such as a chest of drawers as depicted in FIG. 1.

The upper end of the side panel 3 is hingedly attached to the top panel allowing the lower end of the side panel to pivot inwardly into the housing interior. The lower end of the pivotable panel includes a plate 4 on its inwardly facing side. Immediately adjacent the plate on the housing lower panel is a wedge shaped groove 5 for receiving a wedge shaped catch member 6 on the drawer component as will be described in more detail below. Attached to the inner surface of the hinged panel at an intermediate portion thereof is an elongated, substantially horizontal rigid tension spring 7 that engages the exterior surface of the drawer component when the drawer component is slid within the housing.

The drawer component 8 is likewise substantially rectangular having two opposing planar surfaces with a top edge, a bottom edge and two opposing side edges therebetween, one of which is open 9 allowing access to the drawer component interior. Attached to the exterior surface of the opposing side edge of the drawer component is a spring latch mechanism including a rigid, elongated spring 11 having two ends. A first end of the spring is attached to an intermediate portion of the side edge and has a substantially wedge shaped catch member 6 at the opposing end. The catch member 6 extends beyond the bottom edge of the drawer in order to tightly seat within the groove when the drawer is inserted into the housing. The spring 11 biases the catch member into the groove to lock the drawer within the housing. Slidably received within the drawer component interior is a velvet covered panel 20 protruding from which are a plurality of hooks 10 for supporting necklaces, bracelets and similar jewelry items.

To use the above described device, the housing is adhesively secured to the back surface of a furniture item or in a similar inconspicuous location. The drawer member is slid within the open edge of the housing with one of the vertical side edges compressing the tension spring on the hinged panel. The drawer is slid until the wedge shaped catch member tightly seats within the wedge shaped groove on the lower panel of the housing. To eject the drawer, a user pivots the hinged side panel on the housing inwardly whereby the plate dislodges the wedge shaped catch member from the groove at which time the tension spring 7 will thrust the drawer through the housing open edge.

The hooks may vary in size to accomodate various sizes and styles of jewelry items. The housing is preferably black so that it is difficult to see at night, however, any other color may be used. The housing and drawer component may be manufactured with plastic, metal or a similar equivalent. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A concealable jewelry box comprising:

a housing having an opening in communication with an interior chamber;

a jewelry drawer component received within the interior chamber of said housing;

a spring biased catch means for locking said drawer component within said interior chamber and for automatically ejecting said drawer component through said opening, said spring biased catch means including a groove within the interior chamber of said housing and a pivotable panel opposite said opening, said pivotable panel including an elongated first spring horizontally extending from said panel and engaging said drawer component to bias said drawer component toward said opening;

a second rigid spring having a first end attached to said drawer component, and an opposing end having a catch member attached thereto, said catch member dimensioned and configured to seat within said groove whereby said panel may be pivoted inwardly toward said interior chamber to disengage said catch member from said groove so that said first spring ejects said drawer component through said housing opening.

2. A concealable jewelry box according to claim 1 wherein said drawer component is substantially hollow having an opening thereon with a panel slidably received therein, said panel including a soft exterior surface with a plurality of jewelry retaining means thereon.

3. A concealable jewelry box according to claim 1 wherein said housing includes an exterior surface having an adhesive thereon for securing said housing to a furniture item.

4. A concealable jewelry box according to claim 1 wherein said pivotable panel includes a lower end having a plate attached thereto for engaging said catch member when said panel is pivoted inwardly to displace said catch member from said groove.

* * * * *